United States Patent [19]

Davidson

[11] Patent Number: 4,540,107

[45] Date of Patent: Sep. 10, 1985

[54] FIREWOOD STORING AND DISPENSING APPARATUS

[76] Inventor: Richard L. Davidson, 1515 Green Circle Dr., Gastonia, N.C. 28052

[21] Appl. No.: 513,752

[22] Filed: Jul. 14, 1983

[51] Int. Cl.[3] ..... B65H 3/00

[52] U.S. Cl. ..... 221/194; 221/107; 221/291; 221/298; 221/266; 414/126; 312/45; 211/59.2

[58] Field of Search ..... 221/107, 111, 193, 194, 221/195, 291, 298, 299, 301, 266; 414/125, 126; 312/45, 72, 35, 211; 211/59.2

[56] References Cited

U.S. PATENT DOCUMENTS

| | | | |
|---|---|---|---|
| 1,008,429 | 11/1911 | Osmer | 221/301 |
| 1,997,452 | 4/1935 | Cedar | 221/194 |
| 2,877,928 | 3/1959 | Patzer et al. | 221/107 |
| 4,146,122 | 3/1979 | Harris | 194/57 |

*Primary Examiner*—Joseph J. Rolla
*Assistant Examiner*—Nils E. Pedersen
*Attorney, Agent, or Firm*—Richards, Shefte & Pinckney

[57] ABSTRACT

A firewood log storing and dispensing apparatus including a furniture-type cabinet housing having an upright log storage compartment in which logs are vertically stacked, a log delivery opening at the lower end of the compartment of a predetermined size adapted for passage therethrough of one log, and a closure mechanism mounted in the housing to extend across the delivery opening for selectively obstructing and opening the delivery opening to permit gravitational dispensing of logs from the compartment. A log cradle is movably arranged below the delivery opening to be vertically moved between a raised log receiving position at the delivery opening and a lowered log dispensing position spaced therebelow. An opening is provided in the cabinet for access to the cradle at its dispensing position for log removal therefrom.

19 Claims, 6 Drawing Figures

FIG. 2
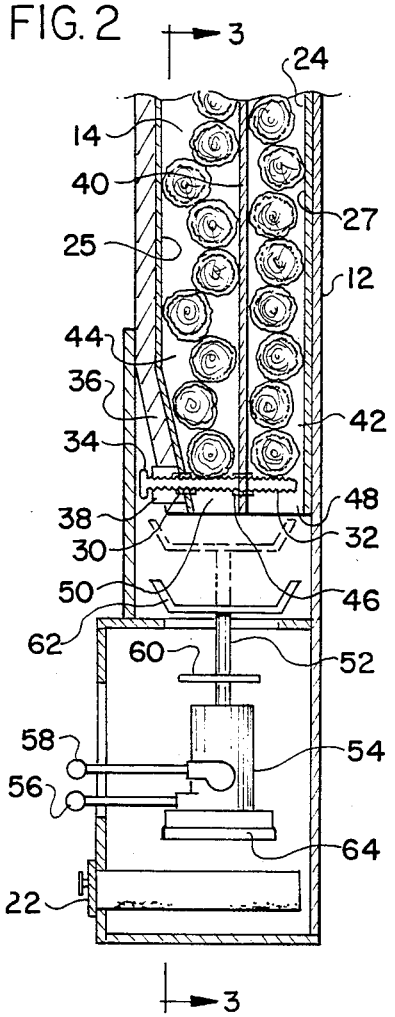
FIG. 3
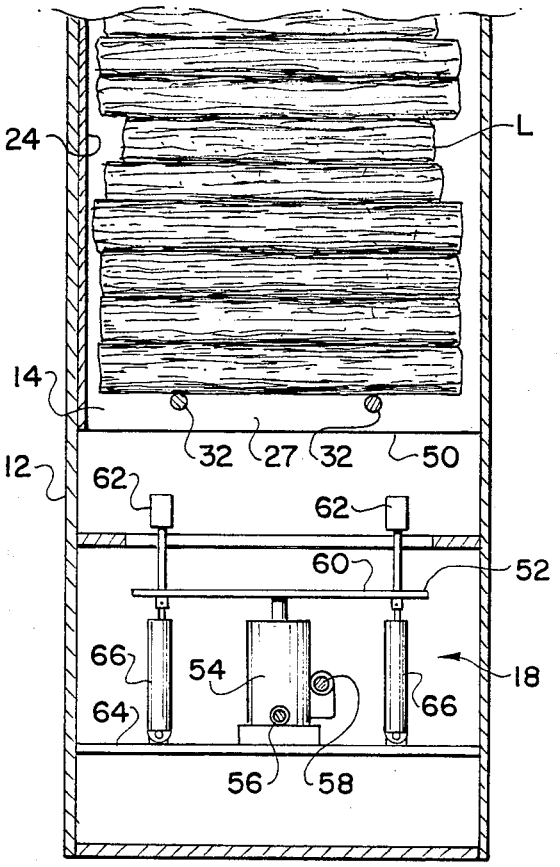
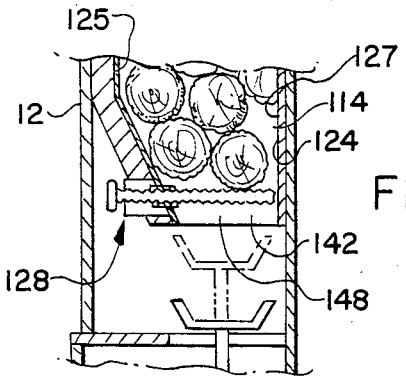
FIG. 4

FIREWOOD STORING AND DISPENSING APPARATUS

BACKGROUND OF THE INVENTION

In recent years, the cost of traditional heating fuels such as heating oil and natural gas has significantly increased while at the same time periodic shortages or unavailability of such fuels has been experienced. As a result, many less conventional methods of space heating have grown in popularity correspondingly. One of the presently most popular alternative fuels is wood in that it is relatively inexpensive, plentiful and an efficient source of heat when burned. To make better use of firewood as a heat source, fireplaces and/or wood-burning stoves have grown greatly in demand as amenities for homes or similar buildings.

To facilitate the use of wood as a heating fuel, various types of log storage racks have been developed and marketed to provide a ready means of storage for a reasonable quantity of firewood. Such storage racks typically comprise little more than an open framework of metal tubing or the like adapted for stacking of firewood thereon. Many people consider firewood to be unsightly and out of place within one's home, even when stacked on a conventional storage rack and, for this reason, such storage racks have not met with widespread acceptance. Instead, many people will store firewood only outdoors necessitating constant trips to and from the outdoor storage area to continuously fuel a wood fire, which as will be understood is quite annoying and detracts from the desirability of wood fires as a heating medium.

In contrast, the present invention provides a log storage and dispensing apparatus of an aesthetically pleasing appearance in the nature of a furniture-type cabinet by which a quantity of firewood logs can be stored in a concealed manner indoors and the logs may be dispensed one-by-one as needed for fueling a fire.

SUMMARY OF THE INVENTION

Briefly described, the log storing and dispensing apparatus of the present invention includes a housing wherein is provided a log storage compartment for containing a quantity of logs in stacked relation, a log delivery opening in the compartment of a predetermined size adapted for passage therethrough of one log, a closure arrangement at the delivery opening selectively movable to restrict and to open the delivery opening for passage of a log therethrough, and a log receptor arrangement adjacent the delivery opening for receiving a log passing therethrough. The receptor arrangement includes a log cradle for supporting one log which cradle is selectively movable between a log receiving position immediately adjacent the delivery opening and a log dispensing position spaced from the receiving position. An access opening is provided in the housing for access to the cradle at its dispensing position for removal of a log therefrom.

In one preferred embodiment, the closure arrangment includes threaded screws reciprocably movable across the delivery opening to restrict and to open it selectively. The compartment is preferably generally upright with the delivery opening at the lower end thereof for gravitational delivery of the logs. A partition may be provided in the storage compartment to divide it into sub-compartments, each for containing a quantity of logs singly stacked one atop another and for dividing the log delivery opening into respective delivery openings for each sub-compartment. The threaded screws extend across the delivery openings in sequence for reciprocal movement first across the delivery opening of one sub-compartment selectively to obstruct and to open it for gravitationally dispensing logs therefrom and, after the logs in the one sub-compartment have all been dispensed, for reciprocal movement across the delivery opening of the other sub-compartment selectively to obstruct and to open it for gravitationally dispensing logs therefrom. Alternatively, the partition wall may be omitted in the compartment and a chute arrangement may be provided associated with the storage compartment which extends taperingly to the delivery opening for directing logs thereto.

In another embodiment, the closure arrangement includes a rotary spindle having opposed restricting portions and a log cradle area therebetween. The spindle is arranged for rotary movement between a restricting position extending across the delivery opening with the log cradle area disposed for receiving a log therethrough and a dispensing position wherein a log in the cradle area will fall therefrom and one of the restricting portions is disposed in the delivery opening to prevent dispensing of other logs. A partition may be provided in the storage compartment to divide it into sub-compartments as describd above and threaded screws are provided to extend across the delivery opening of one sub-compartment for selected threaded movement reciprocably thereacross for selectively first obstructing such delivery opening for dispensing of logs from the other sub-compartment by the spindle and, after the logs in the other sub-compartment have all been dispensed, then selectively opening the delivery opening of the one sub-compartment for dispensing logs therefrom by the spindle.

The receptor arrangement includes a jack operably associated with the cradle for actuating its selective movement between its log receiving and dispensing positions. It is preferred that the housing be a furniture-type cabinet for providing an aesthetically pleasing appearance, selectively openable and closable doors being provided at the access opening.

BRIEF DESCRIPTION OF THE DRAWINGS

FIG. 2 is a partial vertical sectional view thereof taken along line 2—2 of FIG. 1;

FIG. 3 is another partial vertical sectional view thereof taken along line 3—3 of FIG. 2;

FIG. 4 is a partial vertical sectional view similar to FIG. 2 showing a second embodiment of the log storage compartment;

DESCRIPTION OF THE PREFERRED EMBODIMENT

Figure 1:
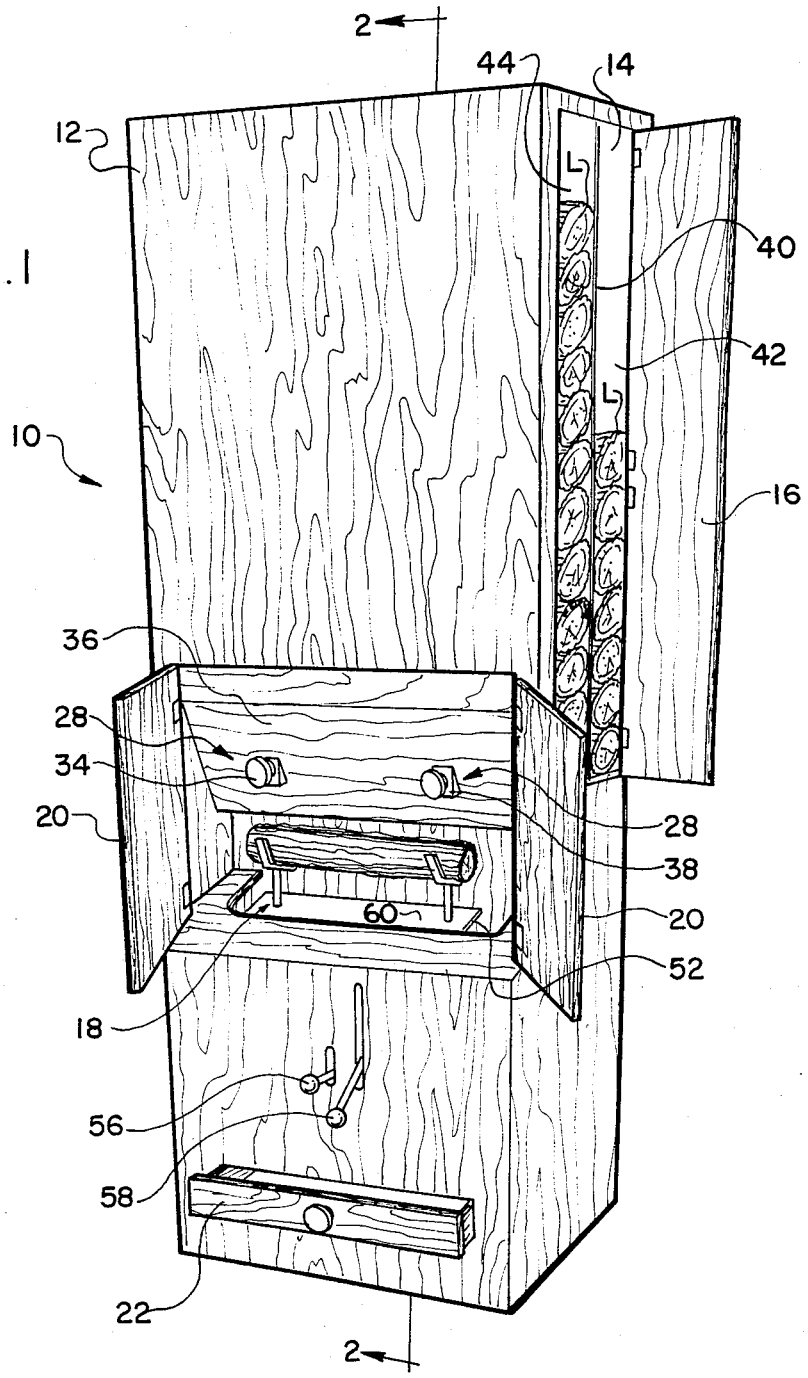
FIG. 1 is a perspective view of the preferred embodiment of the log storing and dispensing apparatus of the present invention.

Referring now to the accompanying drawings and initially to FIG. 1, the log storing and dispensing apparatus of the present invention is indicated generally at 10. The apparatus 10 includes an upright rectangular housing 12 fabricated of planar wood members as a furniture-type cabinet. The cabinet 12 encloses in its upper end a log storage arrangement 14 access to which is provided through a door 16 in one side wall of the cabinet 12. A log receiving and dispensing arrangement 18 is enclosed in the lower end of the cabinet 12, access to which is provided by a pair of doors 20 in the front wall of the cabinet 12. A drawer 22 is provided at the lower end of the cabinet 12 beneath the log receiving and dispensing arrangement 18 for collecting wood dust, chips and like debris.

Referring more particularly to FIGS. 2 and 3, the log storage arrangement 14 includes a generally rectangular metal casing 24 mounted in the upper end of the cabinet 12. The casing 24 is closed on its top and three of its sides, but is open at its fourth side at the door 16 and is open at its lower end. The lower portion of the casing 24 extends downwardly into the access area 26 inwardly of the front doors 20. A pair of bolt arrangements 28 are mounted in the lower end of the front wall 25 of the casing 24 within the access area 26 and extend horizontally inwardly of the casing 24 across its open lower end. Each bolt arrangement 28 includes an internally threaded sleeve 30 fixedly mounted to the front wall 25 of the casing 24 to extend horizontally therethrough and a threaded bolt 32 extending through the sleeve 30 in threaded engagement therewith to be selectively reciprocable across the open lower end of the casing by rotation of the bolt 32 within its sleeve 30. The outward end of each bolt 32 has affixed thereto a wooden handle 34 by which the bolts 32 may be so rotated. A wooden panel 36 covers the portion of the front wall 25 of the casing 24 extending into the access area 26 and a support block 38 is mounted in the panel about each sleeve 30 and bolt 32 to aid in the support thereof. In this manner, the bolt arrangements 28 are adapted to be selectively reciprocated across the open lower end of the casing 24 selectively to obstruct and to open it. As will thus be understood, with the bolt arrangements 28 rearwardly reciprocated across the open lower end of the casing 24 to obstruct it, firewood logs cut to length may be stacked on the bolts 32 within the casing 24. Preferably, the casing 24 includes a central partition wall 40 spaced intermediately of and parallel to its front wall 25 and its rear wall 27 to divide the casing 24 into two sub-compartments 42, 44, each of which is of a size adapted for stacking therein of logs L singly one atop another. The partition wall 40 has fixedly mounted thereto and extending therethrough a pair of internally threaded sleeves 46 respectively arranged in line with the sleeves 30 for threadedly receiving and supporting the bolts 32. The partition wall 40 also divides the lower open end of the casing 24 into two delivery openings 48, 50 for the two sub-compartments 42, 44 respectively.

The log receiving and dispensing arrangement 18 includes a log cradle assembly 52 movably supported on a hydraulic jack 54. The hydraulic jack 54 is of the conventional piston and cylinder type, commonly referred to as a bottle jack, having a first handle 56 rotatably operable to selectively move a valve arrangement within the jack cylinder into appropriate dispositions for raising and lowering operation of the jack and a second handle 58 pivotably arranged for pumping operation for actuating extension of the jack piston. The log cradle assembly 52 includes a metal plate 60 rigidly welded to the extending free end of the piston of the hydraulic jack 54 and includes two U-shaped arms 62 affixed in spaced relation to and extending outwardly from the side of the plate 60 opposite the jack 54. The jack 54 is mounted on a horizontal shelf 64 extending between the side walls of the cabinet 12 at a spacing below the delivery openings 48, 50 of the casing 24. Two pneumatic "door-closer" assemblies 66 extend between the opposite ends of the plate 60 and the shelf 64 to stabilize the cradle assembly 52 and to bias the plate 60 into a lowered position to aid in the lowering of the plate 60 during retraction of the piston of the jack 54 following extension thereof. The arms 62 of the cradle assembly 52 extend upwardly into the access area 26 and the stroke of the hydraulic jack 54 is such as to effect upward and downward reciprocation of the cradle assembly 52 between a raised log receiving position whereat the arms 62 are immediately adjacently below the delivery openings 48, 50 and a lowered log dispensing position whereat the arms 62 are spaced below the delivery openings 48, 50 in disposition for easy access to the arms 62 through the access area 26. The arms 62 are of a sufficient horizontal dimension transversely of the delivery openings 48, 50 to extend across both thereof.

The operation of the present invention will thus be understood. Initially, the handles 34 are rotated to reciprocate the bolts 32 fully inwardly across the delivery openings 48, 50 to obstruct them, after which the two sub-compartments 42, 44 are loaded through the door 16 with pre-cut firewood logs L by stacking the logs singly one above another in each sub-compartment 42, 44. The door 16 is closed and the apparatus is then ready for operation. When a log or logs L are needed for starting or refueling a fire, the access doors 20 are opened and the handles 56, 58 are appropriately operated in conventional manner to raise the cradle assembly 52 to its raised log receiving position with its U-shaped arms 62 immediately adjacently below the delivery openings 48, 50. Once the cradle assembly 52 has thusly been positioned, the handles 34 are slowly rotated to rotate the bolts 32 outwardly sufficiently to open the delivery opening 48 of the rearward sub-compartment 42 to permit the lowermost stacked log L therein to fall through the delivery opening 48 onto the arms 62 of the cradle assembly 52. As will be understood, the other logs L in the rear sub-compartment 42 will also fall downwardly within the rear sub-compartment 42 substantially the same increment of falling distance of the lowermost log. However, because of the close proximity of the arms 62 of the cradle assembly 52 below the delivery openings 48, 50, the lowermost log is permitted to fall only a short distance approximately the same as its one log's thickness, whereby the next log above the dispensed lowermost log is disposed substantially or at least generally above the bolts 32 generally at the initial position of the lowermost dispensed log. Accordingly, with the cradle assembly 52 still in its raised position, the handles 34 are rotated to rotate the bolts 32 to cause them to again be reciprocated inwardly across the delivery opening 48 thereby extending below the next log above the dispensed lowermost log or at least to engage the lower portions thereof and to pinch it against the rearward wall of the casing 24, thusly again obstructing the delivery opening 48 to provent further log dispensing from the rear sub-compartment 42. Following the repositioning of the bolts 32, the handle 56, 58 of the jack 54 are manipulated to lower the cradle assembly 52 to its log dispensing position thereby bringing the dispensed lowermost log into a position in the access area 26 from which the operator can readily remove the log for use. Operation in this manner continues for dispensation of the logs in the rearward compartment 42 one-by-one until the log supply in the rearward sub-compartment 42 has been exhausted, following which the bolt arrangements 28 are similarly manipulated to effect dispensation of the logs in the forward sub-compartment 44 one-by-one. To better facilitate the operation of the bolt arrangments 28 for dispensing logs from the forward sub-compartment 44, the bolts 32 may each be of a conventional two-piece construction of two bolt members each of a length approximately the same as the width of one sub-compartment 42, 44 which bolt members are threadedly affixed in end-to-end assembly, whereby the rearwardmost bolt member of each bolt 32 may be detached from the forwardmost bolt member of each bolt 32 after the supply of logs in the rearward sub-compartment 42 has been exhausted so that the forwardmost bolt members need only be manipulated in operation of the bolt arrangements 28 for log dispensing from the forward sub-compartment 44.

Another embodiment of the storage arrangment of the present invention is shown in FIG. 4 and indicated generally at 114. The storage arrangement 114 basically includes a casing 124 of substantially the same construction as the casing 24 except that the casing 124 does not include a central partition wall and the front wall 125 of the casing 124 is rearwardly tapered toward the rear wall 127 of the casing 124 to define therebetween a single delivery opening 148 of substantially the same size as one delivery opening 48, 50. Logs L are stacked vertically within the entirety of the compartment 142 defined by the casing 124. Two bolt arrangements 128 of substantially the same form as the bolt arrangements 28 are provided in the tapered section of the forward wall of the casing 24 for dispensing operation in the same manner as above described regarding the bolt arrangments 28. In dispensing operation of the storage arrangement 114, the tapered portion of the forward wall of the casing 124 acts as a chute to direct the stacked logs singly to the delivery opening 148, whereby dispensing operation is carried out in substantially the same manner as above-described regarding the embodiment of the storage arrangement 14 of FIGS. 2 and 3. The log receiving and dispensing arrangement 18 is unchanged in the embodiment of FIG. 4 except that the U-shaped arms 62 need not be as wide in the embodiment of FIG. 4 in that they no longer need to extend across two delivery openings 48, 50 but only across a single delivery opening 148.

Figure 5:
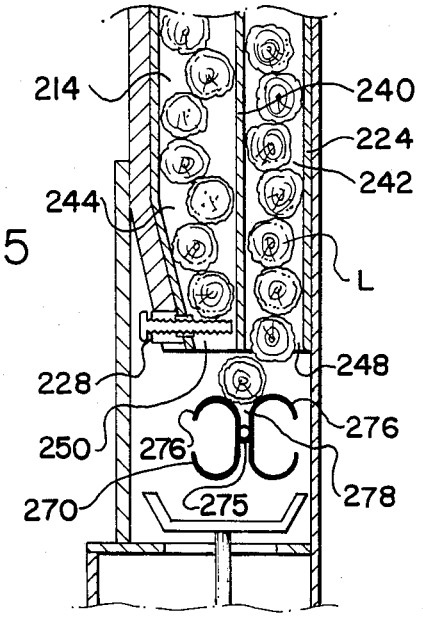
FIG. 5 is a partial vertical sectional view similar to FIG. 2 showing a third embodiment of the log storage compartment.
Figure 6:
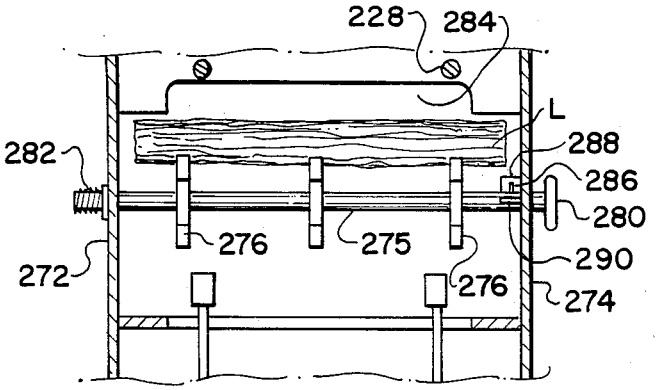
FIG. 6 is a partial vertical sectional view similar to FIG. 3 showing the log storage compartment of FIG. 5.

A third embodiment of the storage arrangement of the present invention is shown in FIGS. 5 and 6 and indicated generally at 214. The storage arrangement 214 includes a casing 224 of identical construction as the casing 24, including a central partition wall 240 dividing the casing 224 into two sub-compartments 242, 244 having respective delivery openings 248, 250. Two bolt arrangments 228 of substantially the same form as the bolt arrangements 28 are provided in the forward sub-compartment 244 but do not extend into the rearward sub-compartment 242. A rotary spindle 270 extends across the width of the casing 224 at the lower end thereof below the two delivery openings 248, 250 and includes a central shaft 275 rotatably mounted at its ends in the two side walls 272, 274 of the casing 224. The spindle 270 includes three pairs of C-shaped restricting members 276 welded to opposite sides of the shaft 275 at spacings along its length, the restricting members 276 forming therebetween a log cradle area 278. The rightward end of the spindle shaft 275 extends through the housing and has an operating knob 280 affixed thereto for manual rotation of the shaft 275. The other end of the shaft 275 extends through the side wall 272 of the casing 224 and has affixed thereto a spring arrangement 282 adapted to urge the shaft leftwardly to place tension thereon sufficient to prevent free rotation thereof while permitting manual rotation against the biasing force of the spring arrangement 282. In operation, the spindle 270 is intially positioned to extend across the two delivery openings 248, 250 with its cradle area 278 facing upwardly and the bolt arrangements 228 are positioned to close the forward compartment 244. Log L are then singly stacked in each subcompartment 248, 250. In this manner, the lowermost log L in the rearward sub-compartment 242 will rest in the cradle area 278 of the spindle 270. The spindle shaft 275 is manually rotated by the knob 280 approximately ninety degrees into an upright disposition, shown in dotted lines in FIG. 5, wherein the lowermost log L is caused to gravitationally fall from the cradle area 278. A slot 284 is provided in the central partition wall 240 to facilitate such rotary movement of the spindle 270 and particularly its restricting members 276. Further, a pin 286 extends from the spindle shaft 275 inwardly of the rightward side wall 274 of the casing 224 and respective stop members 288, 290 are fixed to the inward surface of such side wall 274 for restricting the rotary movement of the spindle shaft 275 through the ninety degree range of movement between its described restricting and upright dispensing positions. Dispensing operation continues in the described manner until all of the logs L contained in the rearward subcompartment 242 have been dispensed, following which the bolt arrangements 228 are moved forwardly to open the forward sub-compartment 244 for dispensing of the logs L therefrom in the same manner. The log receiving and dispensing arrangement 18 is unchanged in this embodiment from the embodiment of FIGS. 1–3.

The present invention has herein been described and illustrated in regard to its preferred embodiments. However, those skilled in the art will readily recognize that the present invention is of a substantially broader utility susceptible of many other embodiments, adaptations, variations and modifications without departing from the substance and scope of the present invention. Accordingly, the present invention is not limited to the particular embodiments herein described and illustrated but instead includes all such other embodiments, adaptations, variations and modifications that would be apparent from or reasonably suggested by the foregoing disclosure to those persons skilled in the art, the present invention being limited only by the claims appended hereto and equivalents thereof.

I claim:

1. Apparatus for storing a quantity of firewood logs or the like and for dispensing said logs individually as desired, comprising a housing, storage means in said housing having a log storage compartment for containing said logs in stacked relation, a log delivery opening in said compartment of a predetermined size adapted for passage therethrough of one said log, and closure means at said log delivery opening selectively movable to restrict and to open said delivery opening to prevent and permit passage of a log therethrough, said clsoure means including threaded screw means reciprocably movable across said delivery opening selectively to obstruct and to open it, log receptor means adjacent said delivery opening for receiving a log passing therethrough, said receptor means including cradle means for supporting one said log and selectively movable between a log receiving position immediately adjacent said delivery opening and a log dispensing position spaced from said log receiving position, and an access opening in said housing for access to said cradle means at said dispensing position for removal of a log from said cradle means.

2. Log storing and dispensing apparatus according to claim 1 and characterized further in that said receptor means includes jack means operably associated with said cradle means for actuating selective movement thereof between said log receiving and dispensing positions.

3. Log storing and dispensing apparatus according to claim 1 and characterized further in that said housing includes selectively openable and closable doors at said access opening.

4. Log storing and dispensing apparatus according to claim 1 and characterized further in that said storage means includes chute means extending taperingly to said delivery opening for directing said logs thereto.

5. Log storing and dispensing apparatus according to claim 4 and characterized further in that said receptor means includes jack means operably associated with said cradle means for actuating selective movement thereof between said log receiving and dispensing positions.

6. Log storing and dispensing apparatus according to claim 1 and characterized further in that said housing comprises a furniture-type cabinet for providing an aesthetically pleasing appearance.

7. Log storing and dispensing apparatus according to claim 6 and characterized further in that said housing includes selectively openable and closable doors at said access opening.

8. Log storing and dispensing apparatus according to claim 1 and characterized further in that said storage means includes partition means dividing said storage compartment into sub-compartments each for containing a quantity of said logs singly stacked in line and for dividing said log delivery opening into respective delivery openings for each said sub-compartment, and said closure means includes threaded screw means reciprocably movable across said delivery openings in sequence for dispensing operation of said sub-compartments sequentially.

9. Log storing and dispensing apparatus according to claim 8 and characterized futher in that said storage means is arranged with said compartment generally upright and with said delivery opening at the lower end thereof for gravitational delivery of said logs.

10. Log storing and dispensing apparatus according to claim 8 and characterized further in that said receptor means includes jack means operably associated with said cradle means for actuating selective movement thereof between said log receiving and dispensing positions.

11. Log storing and dispensing apparatus according to claim 1 and characterized further in that said storage means is arranged with said compartment generally upright and with said delivery opening at the lower end thereof for gravitational delivery of said logs.

12. Log storing and dispensing apparatus according to claim 11 and characterized further in that said storage means includes chute means extending taperingly to said delivery opening for directing said logs thereto.

13. Log storing and dispensing apparatus according to claim 11 and characterized further in that said receptor means includes jack means operably associated with said cradle means for actuating selective movement thereof between said log receiving and dispensing positions.

14. Log storing and dispensing apparatus according to claim 13 and characterized further in that said storage means includes partition means dividing said storage compartment into sub-compartments each for containing a quantity of said logs singly stacked in line and for dividing said log delivery opening into respective delivery openings for each said sub-compartment, and said closure means includes threaded screw means reciprocably movable across said delivery openings in sequence for dispensing operation of said sub-compartments sequentially.

15. Log storing and dispensing apparatus according to claim 13 and characterized further in that said storage means includes chute means extending taperingly to said delivery opening for directing said logs thereto.

16. Apparatus for storing a quantity of firewood logs or the like and for dispensing said logs individually as desired, comprising an upright furniture-type cabinet housing, a substantially enclosed log storage compartment in the upper end of said housing, a generally upright partition in said compartment dividing it into two side-by-side sub-compartments each configured and dimensioned for containing logs singly stacked one above another, a log delivery opening in the lower end of each sub-compartment of a predetermined size adapted for passage therethrough of one said log, a pair of screw members threadedly mounted in said housing to extend across said delivery openings in sequence for selective threaded movement reciprocably thereacross for operation first selectively to obstruct and to open delivery opening of one said sub-compartment for gravitationally dispensing logs therefrom and, after said logs in said one sub-compartment have all been dispensed, selectively to obstruct and to open said delivery opening of the other said sub-compartment for gravitationally dispensing logs therefrom, a log cradle adapted for supporting one log and operably associated with a jack to be selectively movable vertically between a raised log receiving position immediately adjacently below said delivery openings and a lowered log dispensing position, and an across opening in said housing for access to said cradle at said dispensing position for removal of a log from said cradle.

17. Apparatus for storing a quantity of firewood logs or the like and for dispensing said logs individually as desired, comprising an upright furniture-type cabinet housing, a substantially enclosed log storage compartment in the upper end of said housing, a log delivery opening in the lower end of said compartment of a predetermined size adapted for passage therethrough of one said log, a pair of screw members threadedly mounted in said housing to extend across said delivery opening for selective threaded movement reciprocably thereacross for operation selectively to obstruct and to open said delivery opening for gravitationally dispensing logs from said compartment, a log cradle adapted for supporting one log and operably associated with a jack to be selectively movable vertically between a raised log receiving position immediately adjacently below said delivery opening and a lowered log dispensing position, and an access opening in said housing for access to said cradle at said dispensing position for removal of a log from said cradle.

18. Apparatus for storing a quantity of firewood logs or the like and for dispensing said logs individually as desired, comprising an upright furniture-type cabinet housing, a substantially enclosed log storage compartment in the upper end of said housing, a generally upright partition in said compartment dividing it into two side-by-side sub-compartments each configured and dimensioned for containing logs singly stacked one above another, a log delivery opening in the lower end of each sub-compartment of a predetermined size adapted for passage therethrough of one said log, rotary spindle means having opposed restricting positions and a log cradle area therebetween and arranged for rotary movement between a restricting position extending across said delivery openings with said log cradle area disposed for receiving a log through either thereof and a dispensing position wherein a log in said cradle area will fall therefrom and one said restricting portion is disposed in said delivery openings for preventing dispensing of other logs, a pair of screw members threadedly mounted in said housing to extend across one said delivery opening for selective threaded movement reciprocably thereacross for operation first selectively to obstruct said delivery opening of sub-compartment for gravitationally dispensing logs from the other sub-compartment by said spindle means and, after said logs in said other sub-compartment have all been dispensed, selectively to open said delivery opening of sub-compartment for gravitationally dispensing logs therefrom by said spindle means, a log cradle adapted for supporting one log and operably associated with a jack to be selectively movable vertically between a raised log receiving position immediately adjacently below said delivery openings and a lowered log dispensing position, and an access opening in said housing for access to said cradle at said dispensing position for removal of a log from said cradle.

19. Apparatus for storing a quantity of firewood logs or the like and for dispensing said logs individually as desired, comprising a housing, storage means in said housing having a log storage compartment of a predetermined size adapted for passage therethrough of one said log, and closure means at said log delivery opening selectively movable to restrict and to open said delivery opening to prevent and permit passage of a log therethrough, log receptor means including cradle means for supporting one said log and jack means operatively associated with said cradle means for actuating selective movement thereof between a log receiving position immediately adjacent said delivery opening and a log dispensing position spaced from said log receiving position, and an access opening in said housing for access to said cradle means at said dispensing position for removal of a log from said cradle means.

* * * * *

UNITED STATES PATENT OFFICE

CERTIFICATE OF CORRECTION

Patent No. 4,540,107 Dated September 10, 1985

Inventor(s) Richard L. Davidson

It is certified that error appears in the above-identified patent and that said Letters Patent are hereby corrected as shown below:

Column 2, Line 27, delete "describd" and insert therefor -- described -- .

Column 4, Line 62, delete "provent" and insert therefor -- prevent -- .
Column 5, Line 8, delete "arrangments" and insert therefor -- arrangements -- .
Column 6, Line 15, delete "Log" and insert therefor -- Logs -- .
Column 8, Line 49, delete "across" and insert therefor -- access -- .
Column 9, Line 15, delete"positions" and insert therefor -- portions -- .

Signed and Sealed this

*Twenty-ninth* Day of *April 1986*

[SEAL]

*Attest:*

DONALD J. QUIGG

*Attesting Officer* *Commissioner of Patents and Trademarks*